US005444526A

United States Patent [19]

Echapare Ibarrola et al.

[11] Patent Number: 5,444,526

[45] Date of Patent: Aug. 22, 1995

[54] SYSTEM FOR IDENTIFYING OR VALIDATING TOP CROWNS TO BE USED AS A MEANS FOR ACTIVATING A CIRCUIT

[75] Inventors: Jesus Echapare Ibarrola; Jose Louis Pina Insausti, both of Peralta, Spain

[73] Assignee: Azkoyen Industrial, S.A., Peralta, Spain

[21] Appl. No.: 200,970

[22] Filed: Feb. 24, 1994

[30] Foreign Application Priority Data

Mar. 10, 1993 [ES] Spain ..... 9300473

[51] Int. Cl.[6] ..... G07F 3/02

[52] U.S. Cl. ..... 356/71; 356/72; 194/319; 194/328

[58] Field of Search ..... 356/71, 72; 194/328, 194/319

[56] References Cited

U.S. PATENT DOCUMENTS 4,678,994 7/1987 Davies ..... 194/317
4,696,385 9/1987 Davies ..... 194/328
5,046,841 9/1991 Juds et al. ..... 356/71

FOREIGN PATENT DOCUMENTS 259982 10/1990 Japan ..... 194/328
46840 2/1993 Japan ..... 194/328

*Primary Examiner*—Richard A. Rosenberger
*Attorney, Agent, or Firm*—Keck, Mahin & Cate

[57] ABSTRACT

A system is used to validate bottle caps, or top crowns, having particular reflectivity characteristics in plastic covering their undersides and in an alloy from which they are made. This permits the top crowns belonging in a particular promotion to be different, in these respects, from the rest of the top crowns on the market. Validation is carried out with the assistance of an identifying mechanism having an optical sensor and an inductive sensor in front of which the top crowns move while being carried by a conveyor belt or band when inserted in the identifying mechanism. The optical sensor works together with a generator of light having a given wavelength that is reflected by the underside of the cap or top. Thereafter, the light reaches the optical sensor. Signals generated by the optical and inductive sensors, upon the passage of the top crown, are duly processed and compared with the preset valid values in a suitable program. Depending upon the results obtained, the circuit is governed so that it, in turn, operates a hatch allowing the top crowns to be guided towards a rejection duct or an admission duct.

9 Claims, 2 Drawing Sheets

SYSTEM FOR IDENTIFYING OR VALIDATING TOP CROWNS TO BE USED AS A MEANS FOR ACTIVATING A CIRCUIT

OBJECT OF THE INVENTION

The present invention relates to a system for identifying and hence validating top crowns, of the kind used for sealing bottles, for instance refreshment bottles and the like, specifically where such tops are to be used as a means for activating a circuit, for instance a prize-giving circuit for the consumer of the bottled product sealed with the subject top crown.

BACKGROUND OF THE INVENTION

A practice that has been known and used for a long time is the establishment of prizes encouraging the sale of a particular product, and in particular in the case of bottled drinks sealed with top crowns the possible prize is marked on the underside of the top base, that is obviously concealed until opened, the bottle-top being a sort of "voucher" that can be cashed in for the relevant prize at preset places and times.

It is also well-known that there is an increasingly widespread tendency to automate the distribution of this kind of drinks, and suitably constructed machines are hence able to automatically dispense a bottle upon the insertion therein of coins for the price of the product.

This automation tendency has in fact also caused the prize-giving system to progress and thus complementary machines also automatically give such prizes, either next to a machine dispensing drinks automatically or when such drinks are purchased by any other means.

With this automation in the prize-giving it is possible, using the top crown as is conventional to be eligible for such prizes, instead of having some top crowns marked with respective prizes, for all top crowns fulfilling certain conditions to take part, in other words, to be identified as pertaining to the promoted product, and the automatic prize-giving machine can distribute such prizes in accordance with a preset program.

DESCRIPTION OF THE INVENTION

The system for identifying or validating top crowns subject of the invention has been precisely designed to duly analyse, coupled to an automatic prize-giving machine, all top crowns inserted therein, establishing whether a particular top crown belongs to the firm promoting the prizes and hence whether it must be accepted by the machine, or whether it is a different top crown, or any other object that must be invalidated.

More specifically and in order to achieve the above the system subject hereof comprises providing the top crowns pertaining to a particular promotion with likewise particular features that may be detected by an identifying mechanism dealing with the validation or otherwise of the tops inserted therein.

In particular, each top crown shall yield certain features as to the type of alloy used, and the classic plastic coating used in the same to establish a perfect seat and seal upon the neck of the bottle shall have specific light reflection characteristics for a given range of the spectrum, in such a way that a ray of light supplied by the respective generator and with a particular wavelength shall be reflected only on such top crowns as provide suitable reflecting characteristics for the light ray to be picked up by an optical sensor that shall generate the relevant drive signal, which shall jointly with that generated by the inductive sensor measuring the electromechanical features of the top, activate the control circuit that will in turn accept or reject the top, allowing in the event of acceptance the machine to give the relevant prize.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figure 1:
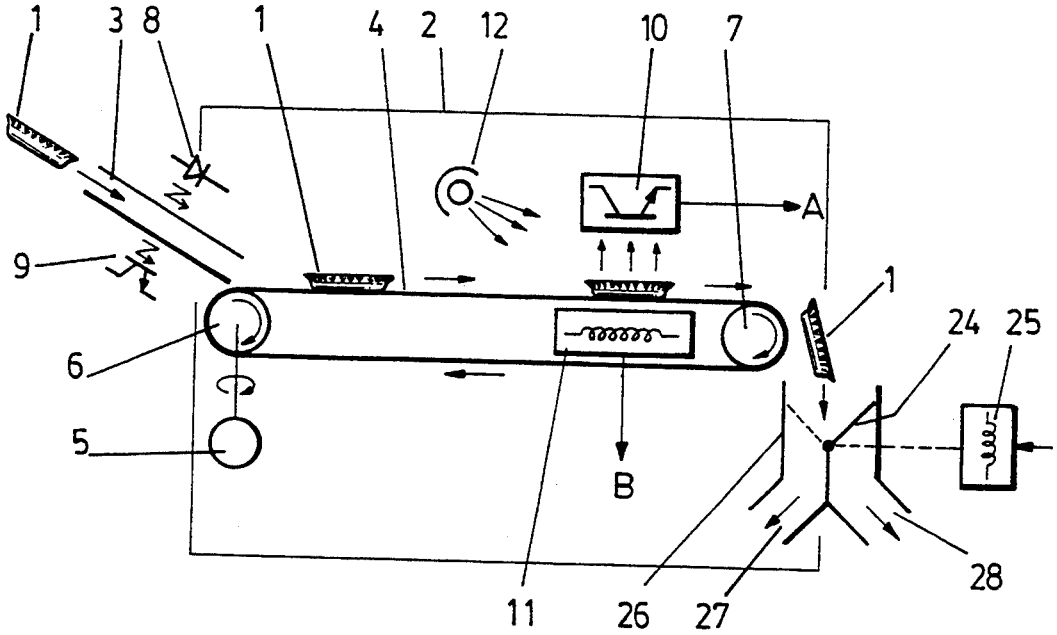
FIG. 1 Is a side elevation diagrammatic view of an identifying mechanism belonging in the system for identifying or validating top crowns, subject of the present invention.

FIG. 1 and as above-mentioned diagrammatically shows the identifying mechanism used in the system for identifying or validating top crowns (1), which mechanism is provided, leading from a suitably sized concealed chamber or casing (2), with an induct (3) for top crowns (1) that is arranged at an angle to drop onto a conveyor belt or band (4) driven by a gearmotor (5), which conveyor belt or band (4) defines a horizontal path between a pair of end rollers (6) and (7) and which drive element is set going each time a top crown (1) is inserted, inasmuch as the induct (4) is fitted with a light emitter (8) and a light receiver (9) that detect the passage of a top crown (1) and set the gearmotor (5) going.

Top crowns (1), that must be inserted through the induct (3) onto the conveyor belt or band (4) in a given position, in particular with the concavity pointing up, excite upon their passage two sensors, in particular an optical sensor (10) and an inductive sensor (11).

The inductive sensor (11), preferably located under the operative portion of the conveyor belt or band (4) as shown in FIG. 1, measures features relating to the top crown position and the specific alloy used to manufacture the same, while the optical sensor (10), because of the special characteristics of a top crown acceptable as valid, receives a ray of light having a given wavelength by reflection, supplied by a suitable generator (12).

Figure 4:
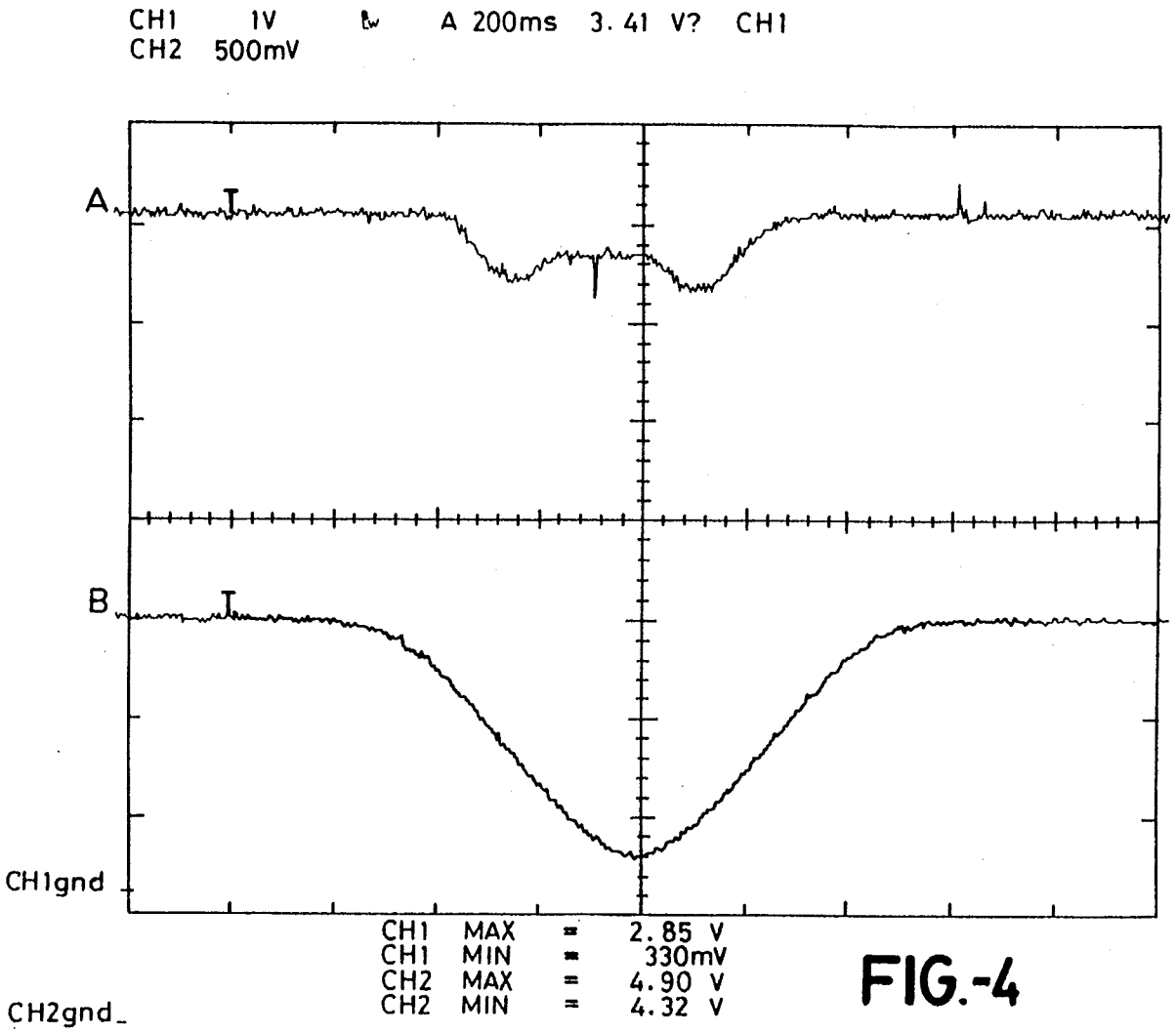
FIG. 4 Is finally a voltage/time diagram of the signals generated by the optical and inductive sensors upon the passage of a top crown acceptable as valid.

It has in particular been provided that the top crown (1) is fitted with a narrow perimetric fringe (13) with a greater degree of reflectivity or fluorescence, and a middle area (14) of a lesser degree, so that the response of the top crown to the light generator (12) and upon the passage in front of the optical sensor (10), shall give rise to the response shown in the upper graph of FIG. 4, marked A, in which the initial sector refers to the period prior to the passage of the top crown (1) in front of the optical sensor, the middle part refers to the said passage and the latter part to the return to the position of rest of the first part. This same figure sets forth, at a lower level and as aforesaid, marked with the letter B, the graph showing the voltage change undergone by the inductive sensor (11) likewise upon the passage of the top crown (1).

Figure 2:
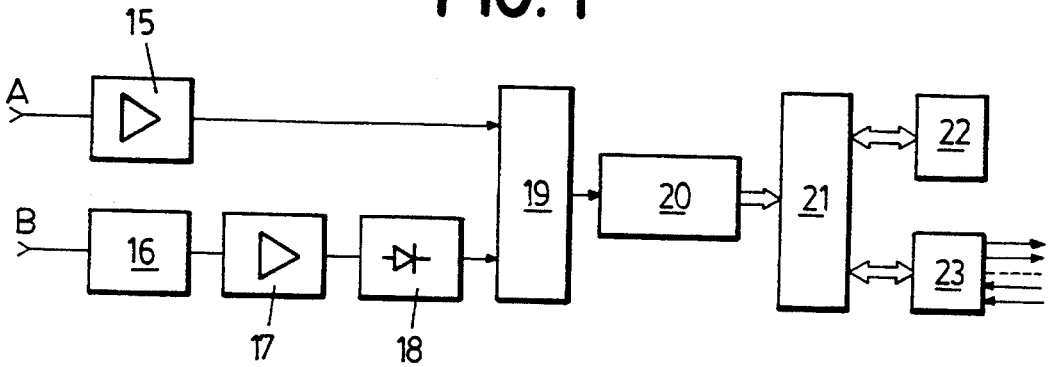
FIG. 2 Is a block diagram of the drive circuit receiving the signals generated by the sensors of the identifying mechanism of the above figure.
Figure 3:
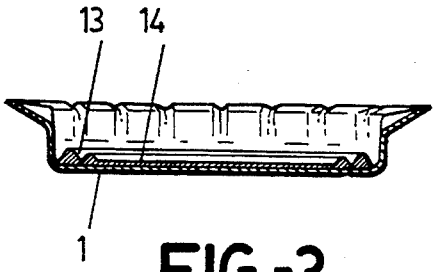
FIG. 3 Is a diametric sectional close-view of a top crown of the kind designed to be identified or validated by the subject system.

These signals A and B are treated in an electronic circuit, for instance as shown in FIG. 2, so that signal A is passed through a conditioner amplifier (15) whereas signal B is passed through an oscillator (16), an amplifier (17) and a rectifier (18), both signals meeting at a multiplexer (19) that sends the resulting signal through a converter (20) to a microprocessor (21) that has a memory unit (22) which shall have duly stored the program selecting the top crowns, which microprocessor (21) shall through an input, output and control unit (23) govern a hatch (24) through an electric magnet (25) or like element, which hatch is fitted in a duct (26) collecting the top crowns (1) when they leave the conveyor belt or band (4), as shown in FIG. 1, and that depending on the position taken up shall send the top crowns (1) towards the rejection duct (27) or the admission duct (28).

We claim:

1. A system for identifying or validating a cap comprising:

a casing defining a protective chamber;

light emitter and receiver devices for detecting passage of said cap into said chamber;

an induct, arranged at an angle causing said cap to drop into said chamber, to which said light emitter and receiver devices are fitted;

a conveyor in said chamber to which said induct leads;

means for driving said conveyor, when the light emitter and receiver devices detect passage of said cap, so as to carry the cap along a path;

a generator in said chamber for generating a ray of light;

an optical sensor in said chamber for receiving said ray of light and generating a first response signal representative of a first characteristic of said cap;

inductive means in said chamber for measuring features relating to a second characteristic of said cap and generating a second response signal representative of said second characteristic of said cap;

means for processing said first response signal and said second response signal and generating an output;

means for defining a collection duct, a rejection duct and an admission duct at an end of the path, said cap being deposited into said collection duct by said conveyor; and means, responsive to said output, for deflecting said cap into one of said rejection duct and said admission duct.

2. A system as defined by claim 1, and further comprising an insert fixed to the cap having a narrow upstanding fringe, with a first degree of reflectivity or fluorescence, at its perimeter and a middle area, with a second degree of reflectivity or fluorescence, for reflecting said ray of light generated by said generator towards said optical sensor.

3. A system as defined by claim 1, wherein said second characteristic relates to an alloy from which the cap is made.

4. A system as defined by claim 1, wherein said first characteristic relates to validity of the cap.

5. A system as defined by claim 4, wherein said second characteristic relates to an alloy from which the cap is made.

6. A system as defined by claim 4, wherein said cap is deflected into said admission duct when said cap is valid.

7. A system as defined by claim 1, wherein said means for deflecting said cap comprises a hatch in said collection duct which is selectively movable between a first position, blocking off said rejection duct, and a second position, blocking off said admission duct.

8. A system as defined by claim 7, wherein said means for deflecting said cap further comprises an electric magnet selectively operated by said output to move said hatch between said first position and said second position.

9. A system as defined by claim 1, wherein the means for processing said first response signal and said second response signal comprises a memory unit and a microprocessor for comparing said first response signal and said second response signal with information stored in said memory unit.

* * * * *